US009415592B2

(12) United States Patent
Iijima

(10) Patent No.: US 9,415,592 B2
(45) Date of Patent: Aug. 16, 2016

(54) INK JET HEAD HAVING A PLURALITY OF DRIVE CIRCUITS HOUSED IN A CASING

(71) Applicants: KABUSHIKI KAISHA TOSHIBA, Tokyo (JP); TOSHIBA TEC KABUSHIKI KAISHA, Tokyo (JP)

(72) Inventor: Tomomi Iijima, Mishima Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/713,576

(22) Filed: May 15, 2015

(65) Prior Publication Data

US 2015/0328883 A1 Nov. 19, 2015

(30) Foreign Application Priority Data

May 16, 2014 (JP) ..... 2014-102761

(51) Int. Cl.
*B41J 2/05* (2006.01)
*B41J 2/14* (2006.01)
*B41J 2/045* (2006.01)

(52) U.S. Cl.
CPC ..... *B41J 2/14233* (2013.01); *B41J 2/04541* (2013.01); *B41J 2002/14362* (2013.01); *B41J 2002/14387* (2013.01); *B41J 2002/14491* (2013.01)

(58) Field of Classification Search
CPC ..... B41J 2/14072; B41J 2002/14491
See application file for complete search history.

(56) References Cited

U.S. PATENT DOCUMENTS

2012/0147096 A1* 6/2012 Yamamoto ..... B41J 2/14209 347/61
2013/0076838 A1* 3/2013 Suzuki ..... B41J 2/14201 347/68

FOREIGN PATENT DOCUMENTS

JP 2005-329551 A 12/2005

* cited by examiner

*Primary Examiner* — Julian Huffman
(74) *Attorney, Agent, or Firm* — Patterson & Sheridan, LLP

(57) ABSTRACT

An ink jet head includes an ejection unit including first nozzles arranged along a line, second nozzles arranged parallel to the first nozzles, a first actuator configured to cause ink to be ejected from the first nozzles, and a second actuator configured to cause ink to be ejected from the second nozzles, a first drive circuit configured to drive the first actuator, a second drive circuit configured to drive the second actuator, and a casing. The casing has a first space on a first side of the casing and a second space on a second side of the casing that is opposite to the first side. The first drive circuit is housed in the first space and the second drive circuit is housed in the second space.

20 Claims, 14 Drawing Sheets

INK JET HEAD HAVING A PLURALITY OF DRIVE CIRCUITS HOUSED IN A CASING

CROSS-REFERENCE TO RELATED APPLICATION

This application is based upon and claims the benefit of priority from Japanese Patent Application No. 2014-102761, filed May 16, 2014, the entire contents of which are incorporated herein by reference.

FIELD

An embodiment described herein relates to an ink jet head, particularly an ink jet head having a plurality of drive circuits configured to drive actuators to eject ink and housed in a casing.

BACKGROUND

An ink jet printer includes one or more ink jet heads arranged in a main scanning direction. Printing can be performed by moving a recording medium such as paper in a sub scanning direction relative to the ink jet heads.

One type of an ink jet head used in the ink jet printer includes a head having a piezoelectric element for ejecting ink and a driver IC for driving the piezoelectric element. Further, a circuit board on which the driver IC is mounted and a circuit board on which electronic parts are mounted are enclosed in a casing, in order to prevent ink or a foreign substance from being attached to the driver IC or the electronic parts.

When the driver IC is housed in the casing, it would be preferable to radiate heat generated by the driver IC to the outside of the casing.

DETAILED DESCRIPTION

An embodiment provides an ink jet head which may decrease the number of portions of a casing to which seal treatment is applied and also may efficiently radiate heat generated from equipment housed in the casing to the outside.

In general, according to an embodiment, an ink jet head includes an ejection unit including first nozzles arranged along a line, second nozzles arranged parallel to the first nozzles, a first actuator configured to cause ink to be ejected from the first nozzles, and a second actuator configured to cause ink to be ejected from the second nozzles, a first drive circuit configured to drive the first actuator, a second drive circuit configured to drive the second actuator, and a casing. The casing has a first space on a first side of the casing and a second space on a second side of the casing that is opposite to the first side. The first drive circuit is housed in the first space and the second drive circuit is housed in the second space.

Hereinafter, an embodiment of the present disclosure is explained by reference to drawings. In the description hereinafter, an orthogonal coordinate system is defined by an X axis, a Y axis and a Z axis, which are orthogonal to each other.

Figure 1:
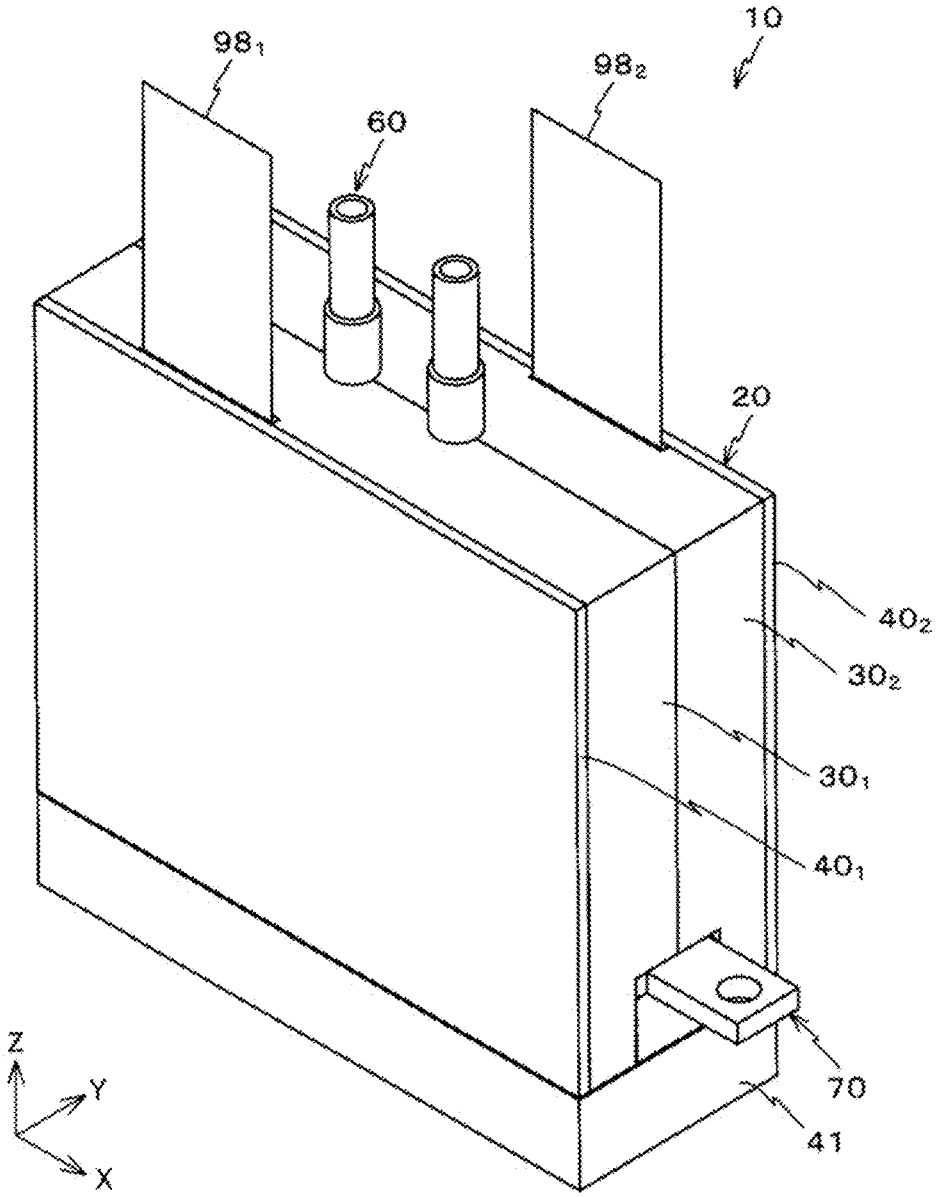
FIG. 1 is a perspective view of an inkjet head according to an embodiment.

FIG. 1 is a perspective view of an inkjet head 10 according to the embodiment. The inkjet head 10 is a share-mode shared-wall-type inkjet head. The inkjet head 10 includes a casing 20, a mask plate 41, and a circulation system 60 and a support unit 70, which extend from the casing 20.

As shown in FIG. 1, the casing 20 is formed of two casing members $\mathbf{30}_1$, $\mathbf{30}_2$ and two covers $\mathbf{40}_1$, $\mathbf{40}_2$.

Figure 2:
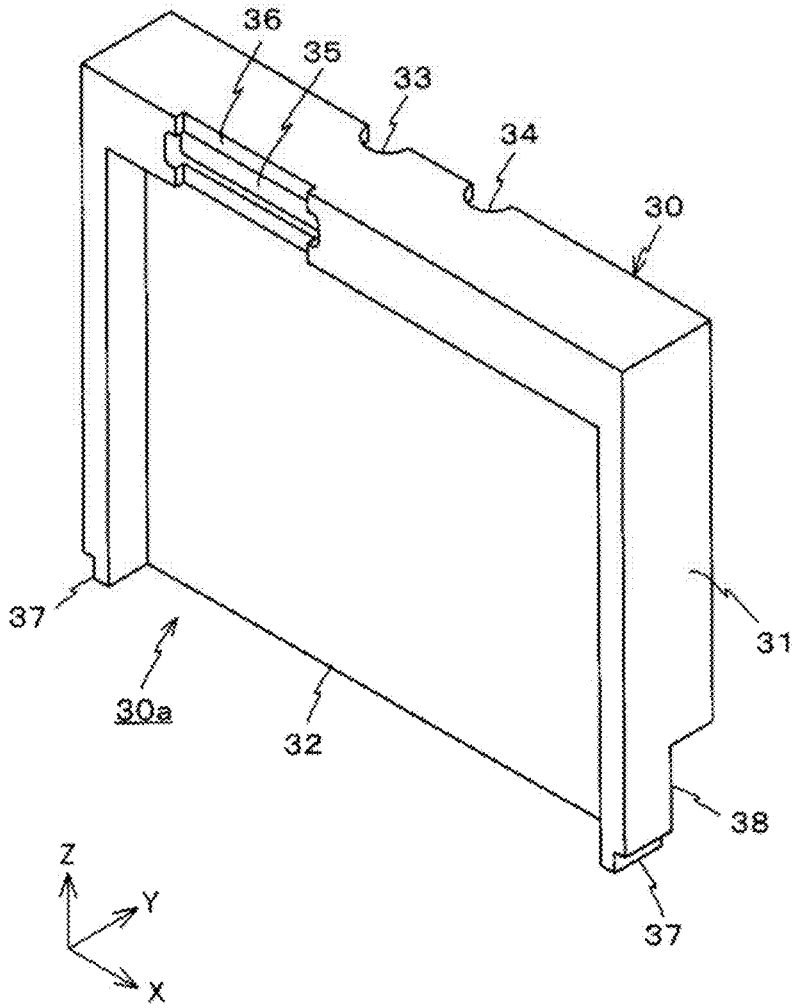
FIGS. 2 and 3 are each a perspective view of a casing of the inkjet head.
Figure 3:
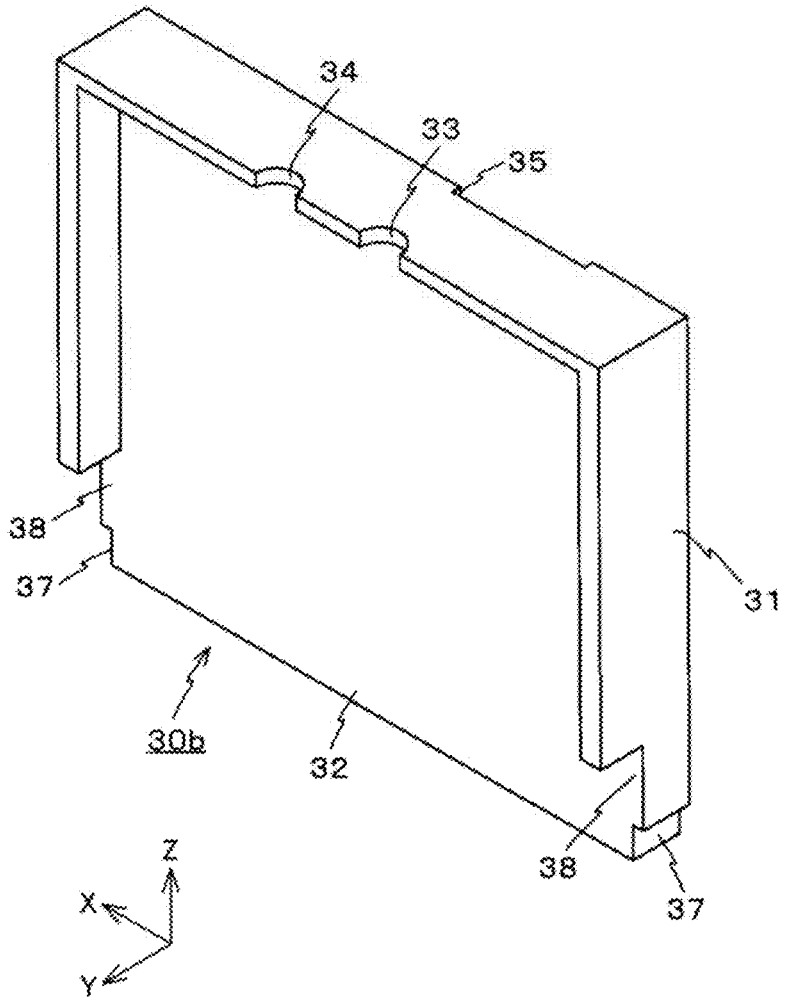

FIG. 2 is a perspective view of the casing member $\mathbf{30}_1$. Further, FIG. 3 is a perspective view of the casing member $\mathbf{30}_1$ as viewed from a +Y side in FIG. 2. The casing member $\mathbf{30}_1$ is made of a material having a relatively high thermal conductivity such as aluminum, for example. As shown in FIG. 2 and FIG. 3, the casing member $\mathbf{30}_1$ has two portions, that is, a U-shaped frame portion 31 and an inner wall portion 32 which divides a space surrounded by the frame portion 31 into two spaces 30*a*, 30*b*.

The frame portion 31 of the casing member $\mathbf{30}_1$ is formed over an upper edge of the inner wall portion 32 and edges of the inner wall portion 32 on both sides in the X axis direction. A cutout 37 is formed on lower end portions of the frame portion 31, and a cutout 38 is formed on a portion of the frame portion 31 which defines the space 30*b*.

Semicircular-shaped cutouts 33, 34, which are connected to the space 30*b*, are formed on one side of an upper portion of the frame portion 31. Further, a cutout 36, which is connected to the space 30*a*, and a recessed portion 35, which extends across the cutout 36 are formed on the other side of the upper portion of the frame portion 31. The casing member $\mathbf{30}_2$ has a substantially similar structure as the casing member $\mathbf{30}_1$.

Returning to FIG. 1, the cover 40 is formed of a rectangular planar plate. In the same manner as the casing 30 (casing members $\mathbf{30}_1$, $\mathbf{30}_2$), the cover 40 is also made of a material having a relatively high thermal conductivity such as aluminum.

Figure 4:
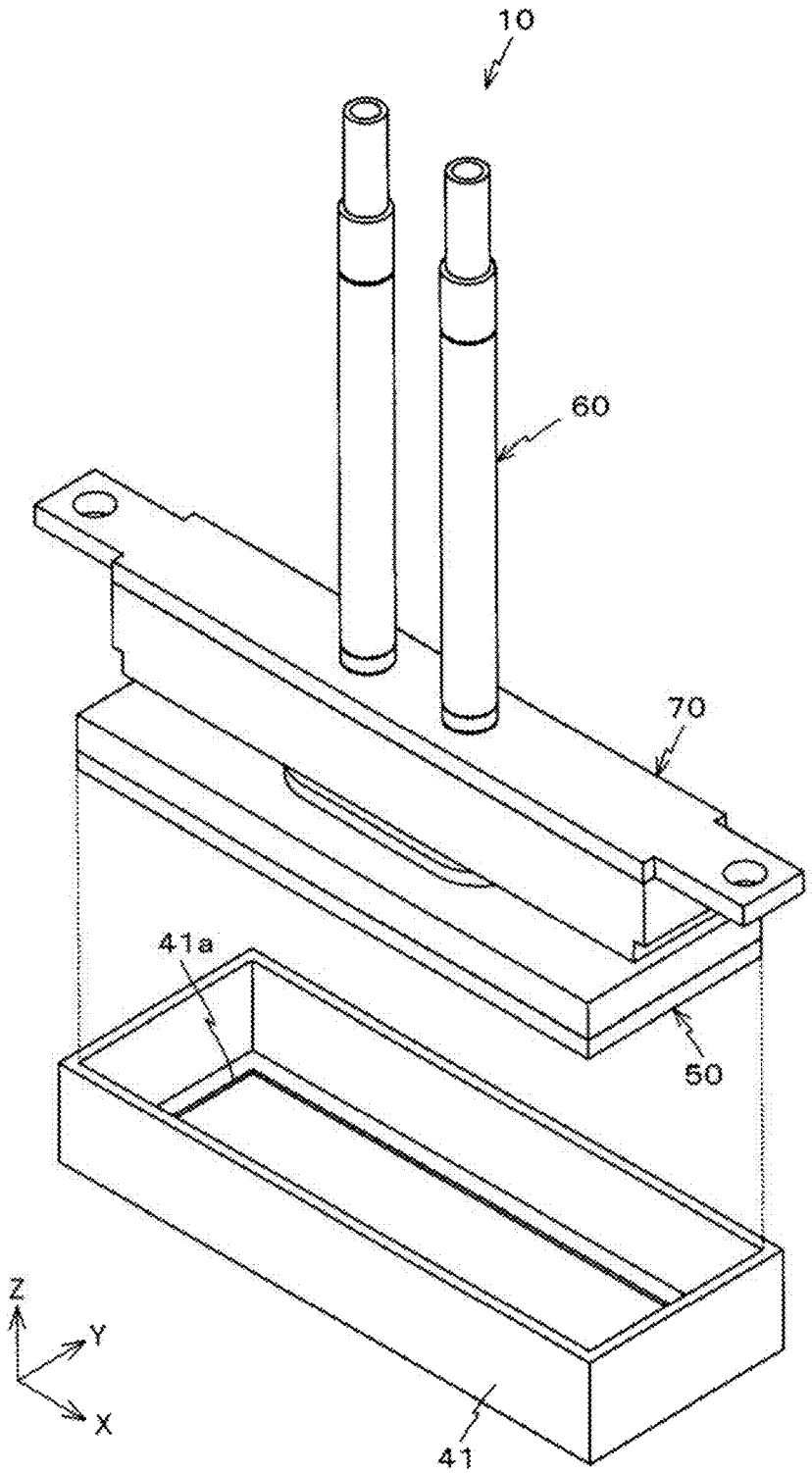
FIG. 4 is an exploded perspective view of a circulation system, a support unit, a mask plate, and a head of the inkjet head.

FIG. 4 is an exploded perspective view of the mask plate (third cover) 41, the circulation system 60, the support unit 70, and a head 50, which form the inkjet head 10. As shown in FIG. 4, the mask plate 41 is a frame-shaped member where a longitudinal direction is the X axis direction. A projecting portion 41*a*, which projects inward, is formed on a lower end portion of the mask plate 41.

Figure 5:
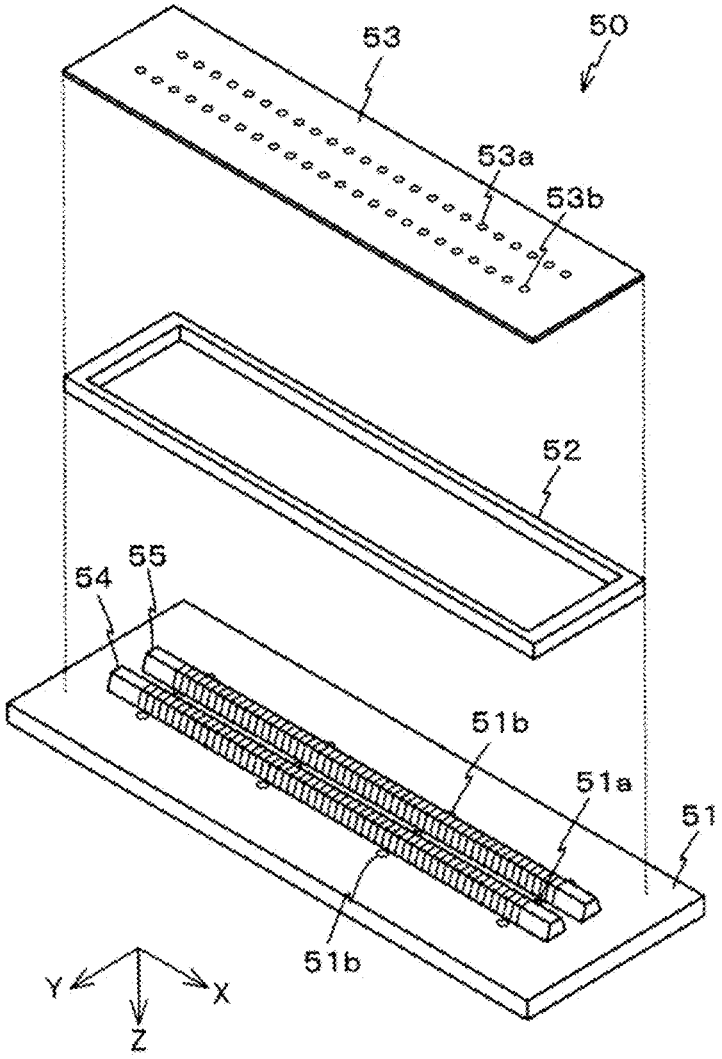
FIG. 5 is an exploded perspective view of the head.

FIG. 5 is an exploded perspective view of the head 50. As shown in FIG. 5, the head 50 includes a base substrate 51, a frame 52, and an orifice plate 53.

The base substrate 51 is a rectangular-plate-like member of which longitudinal direction is the X axis direction. The base substrate 51 is made of alumina, for example. Four openings 51*a* are formed in a center portion of the base substrate 51 in the Y axis direction and arranged at intervals along the X axis direction. Further, four openings 51*b* are formed in the base substrate 51 on each of a −Y side and a +Y side of the opening 51*a* and arranged at intervals along the X axis direction.

Two drive units 54, 55 are disposed on an upper surface of the base substrate 51. As shown in FIG. 5, each of the drive units 54, 55 are disposed on opposite sides of the openings 51*a* in the Y axis direction.

Each of the drive units 54, 55 is formed of a plurality of trapezoidal piezoelectric elements arranged along the X axis direction, and a space formed between adjacent two piezoelectric elements forms a pressure chamber. Further, the respective piezoelectric elements which form the drive units 54, 55 are connected to an electrode pattern (not shown) formed on a −Z side surface of the base substrate 51.

The frame 52 is a frame-like member of which longitudinal direction is the X axis direction. The frame 52 is, for example, made of ceramic, alumina, or metal such as aluminum or stainless steel of which surface is covered with an insulation material. The frame 52 is smaller than the base substrate 51 in the x axis and y axis directions.

The orifice plate 53 is a rectangular-shaped sheet formed of polyimide or the like, and the longitudinal direction thereof is the X axis direction. A plurality of openings 53*a*, each of which has a circular shape, is formed in the orifice plate 53 and arranged at equal intervals along the X axis direction. Further, a plurality of openings 53*b*, each of which has a circular shape, is formed in the orifice plate 53 on a +Y side of the openings 53*a* and arranged at equal intervals along the X axis direction. The openings 53*a*, 53*b* function as nozzles for ejecting ink, which circulates within the inkjet head 10, to a recording medium such as paper.

The base substrate 51, the frame 52, and the orifice plate 53 formed as described above are integrally formed with each other by adhering the frame 52 to a −Z side surface of the base substrate 51 and by adhering the orifice plate 53 to a −Z side surface of the frame 52, and as a result the head 50 is formed.

Figure 6:
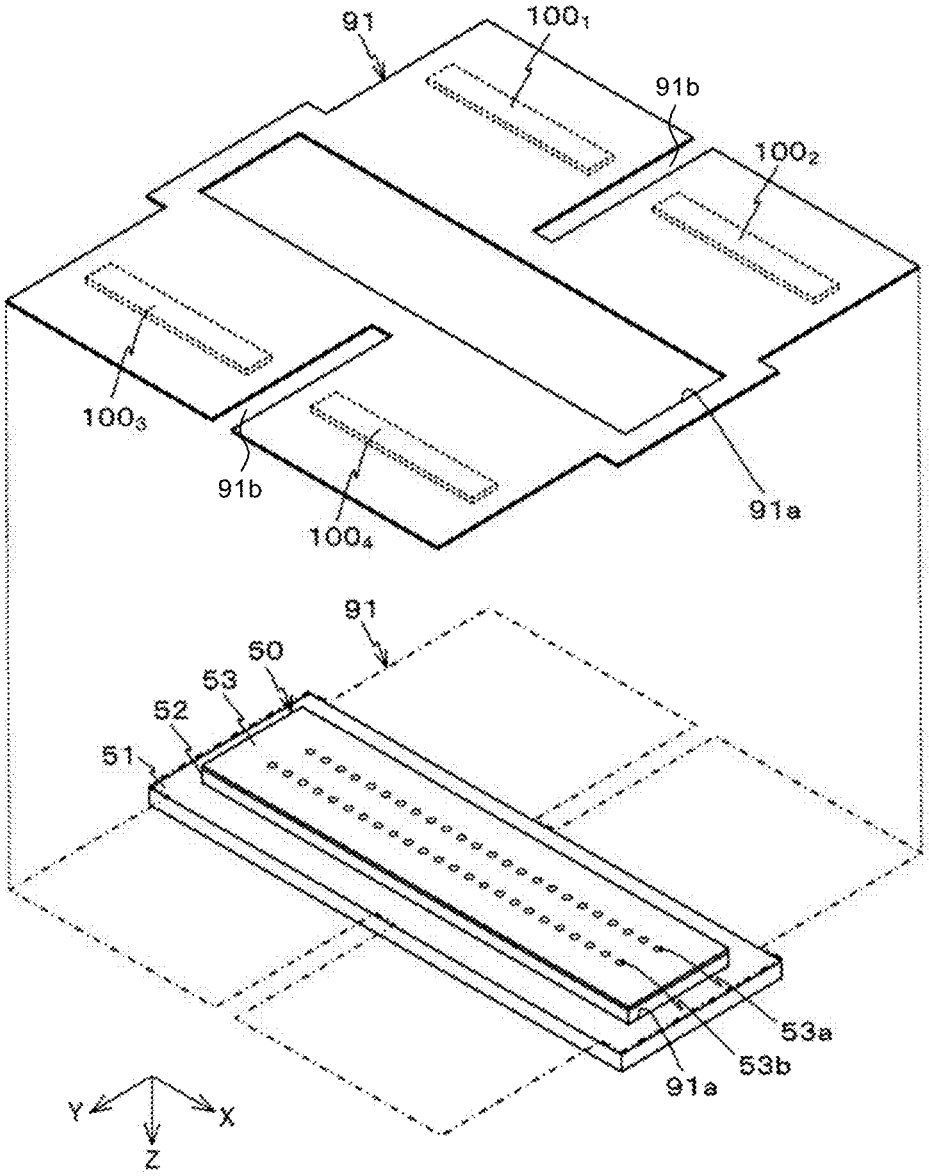
FIG. 6 is a perspective view of the head and a flexible printed circuit board to be attached thereto.

As shown in FIG. 6, a flexible printed circuit board 91 is attached to the head 50. The flexible printed circuit board 91 is, for example, formed of an insulation film and a conductor layer. An opening 91*a*, of which longitudinal direction is the X axis direction, is formed in the center of the flexible printed circuit board 91. and two slits 91*b* are formed in a center portion of the flexible printed circuit board 91 and extend from outer edges of the flexible printed circuit board 91 in the Y axis direction, on a +Y side and a −Y side of the opening 91*a*, respectively. Four driver ICs 100 are mounted on a +Z side surface of the flexible printed circuit board 91.

Figure 7:
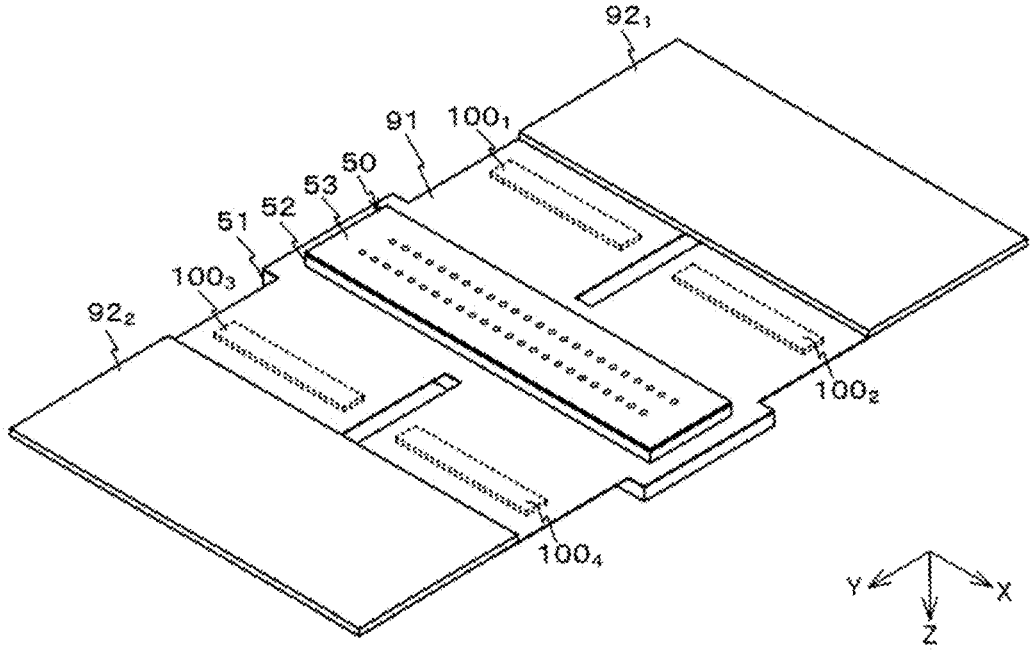
FIG. 7 is a perspective view of the head, the flexible printed circuit board, and a rigid printed circuit board.

As shown in FIG. 7, the flexible printed circuit board 91 is adhered to the base substrate 51 in a state where the frame 52 of the head 50 is inserted into the opening 91*a*. According to such a configuration, the electrode pattern formed on a −Z side surface of the base substrate 51 and the conductor layer of the flexible printed circuit board 91 are electrically connected to each other. As a result, the respective driver ICs 100 and the respective corresponding piezoelectric elements formed in the head 50 are connected to each other. In the head 50, the piezoelectric elements which form the drive unit 55 are driven by driver ICs $\mathbf{100}_1$, $\mathbf{100}_2$. Similarly, the piezoelectric elements which form the drive unit 54 are driven by driver ICs $\mathbf{100}_3$, $\mathbf{100}_4$. The driver ICs $\mathbf{100}_1$, $\mathbf{100}_2$ may be referred to as a first drive circuit, and the driver ICs $\mathbf{100}_3$, $\mathbf{100}_4$ may be referred to as a second drive circuit.

Two rigid printed circuit boards $\mathbf{92}_1$, $\mathbf{92}_2$ are connected to a −Y side and a +Y side of the flexible printed circuit board 91, respectively. Electronic parts such as connectors and semiconductor elements are mounted on front and back surfaces of the rigid printed circuit boards $\mathbf{92}_1$, $\mathbf{92}_2$, respectively.

Figure 8:
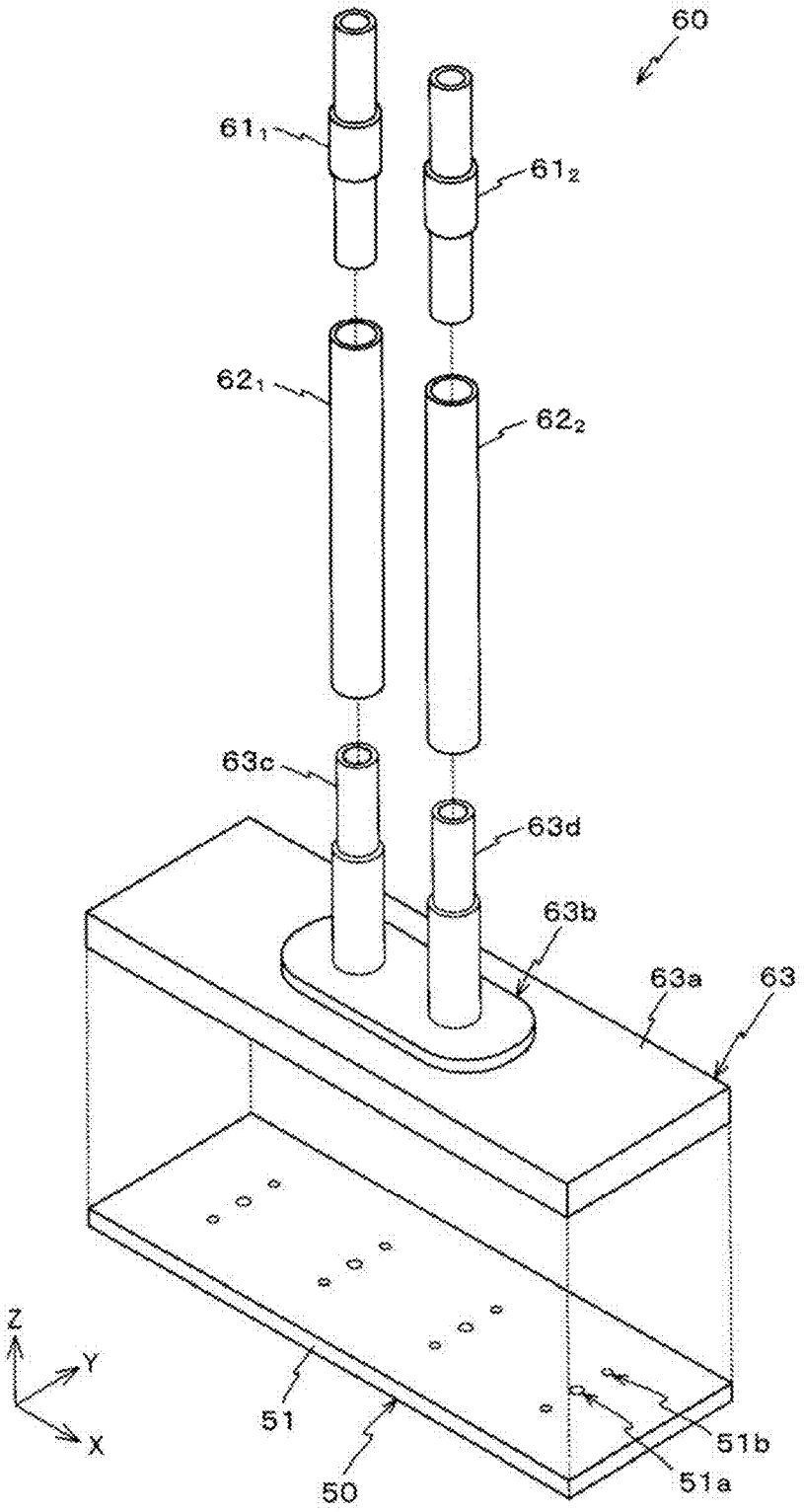
FIG. 8 is an exploded perspective view of a circulation system of the inkjet head.

FIG. 8 is an exploded perspective view of the circulation system 60. As shown in FIG. 8, the circulation system 60 includes a manifold 63, a pair of pipes $\mathbf{62}_1$, $\mathbf{62}_2$, and a pair of connectors $\mathbf{61}_1$, $\mathbf{61}_2$.

The connectors $\mathbf{61}_1$, $\mathbf{61}_2$ are members for connecting pipes. The connectors $\mathbf{61}_1$, $\mathbf{61}_2$ are formed such that a diameter of an upper end portion and a diameter of a lower end portion are smaller than diameters of other portions. The upper end portions of these connectors $\mathbf{61}_1$, $\mathbf{61}_2$ are connected to a circulation pump for circulating an ink through a pipe (not shown) and an ink tank for storing ink, respectively. Further, pipes $\mathbf{62}_1$, $\mathbf{62}_2$ are connected to the lower end portions of the connectors $\mathbf{61}_1$, $\mathbf{61}_2$, respectively.

The pipes $\mathbf{62}_1$, $\mathbf{62}_2$ are pipes extending in the Z axis direction. These pipes $\mathbf{62}_1$, $\mathbf{62}_2$ are made of a material having elasticity, such as rubber or silicon rubber.

The manifold 63 includes a base 63*a*, in which a flow passage is formed, and a connector 63*b*, which is adhered to the base 63*a*.

The connector 63*b* includes a pair of connecting portions 63*c*, 63*d* which project in the +Z direction. The connecting portions 63*c*, 63*d* are formed such that a diameter of an upper end portion is smaller than diameters of other portions.

Through the flow passage formed in the base 63*a*, the connecting portion 63*c* is connected to four openings 51*a* formed in the base substrate 51 of the head 50, and the connecting portion 63*d* is connected to the openings 51*b* formed in the base substrate 51.

The connectors $\mathbf{61}_1$, $\mathbf{61}_2$, pipes $\mathbf{62}_1$, $\mathbf{62}_2$, and manifold 63 are connected with each other as shown in FIG. 4 in such a manner that lower ends of the pipes $\mathbf{62}_1$, $\mathbf{62}_2$ are connected to the connecting portions 63*c*, 63*d* of the manifold 63, and upper ends of the pipes $\mathbf{62}_1$, $\mathbf{62}_2$ are connected to the connectors $\mathbf{61}_1$, $\mathbf{61}_2$. The circulation system 60 has such a configuration.

Figure 9:
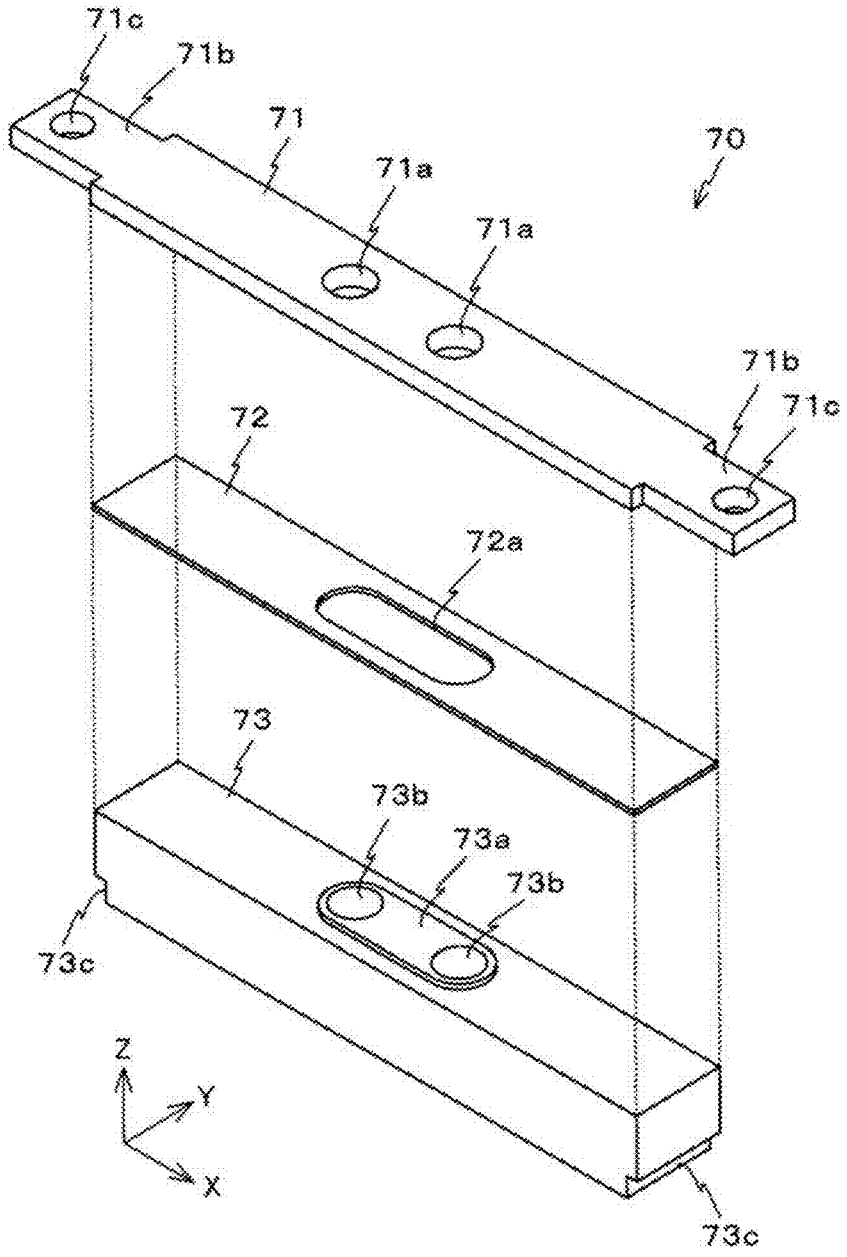
FIG. 9 is an exploded perspective view of a support unit of the inkjet head.

FIG. 9 is an exploded perspective view of the support unit 70. As shown in FIG. 9, the support unit 70 includes a support plate 71, a seal member 72, and a support member 73.

The support plate 71 is a metal member, and the longitudinal direction thereof is the X axis direction. Both end portions 71*b* of the support plate 71 are formed such that a size in the Y axis direction thereof is slightly smaller than sizes of other portions in the Y axis direction. Further, a circular-shaped opening 71*c*, which penetrates the support plate 71 in the Z axis direction, is formed in both end portions 71*b*. Further, two circular-shaped openings 71*a*, which penetrate the support plate 71 in the Z axis direction, are formed in a center portion of the support plate 71 in the x axis direction. Two openings 71*a* are arranged with a predetermined distance therebetween in the X axis direction.

The seal member 72 is a sheet-like elastic member, and the longitudinal direction thereof is the X axis direction. The seal member 72 is, for example, made of rubber or silicon rubber. An elongated hole 72*a*, of which longitudinal direction is the X axis direction, is formed in a center portion of the seal member 72 in the x axis direction.

The support member 73 is a rectangular parallelepiped member, of which longitudinal direction is the X axis direction. A projecting portion 73*a* which projects upward (+Z direction) is formed on a center portion of an upper surface of the support member 73 in the x axis direction. The projecting portion 73*a* is formed such that the projecting portion 73*a* fit within the elongated hole formed in the seal member 72. Two circular openings 73*b* which penetrate the support member 73 in the z axis direction are formed in the support member 73. These two openings 73*b* are arranged with a predetermined distance therebetween in the X axis direction. A cutout 73*c* is formed on both lower end portions of the support member 73 in the x axis direction, respectively.

The seal member 72 is disposed on the upper surface of the support member 73 such that the projecting portion 73*a* of the support member 73 fits within the elongated hole 72*a* formed in the seal member 72. The support plate 71 is fixed to the support member 73 with the seal member 72 disposed therebetween using bolts or the like. According to such a configuration, the support plate 71, the seal member 72, and the support member 73 are fixed with each other, and as a result the support unit 70 is formed.

Next, the steps of assembling the casing 30, the mask plate 41, the head 50, the circulation system 60, and the support unit 70 are described.

Figure 10:
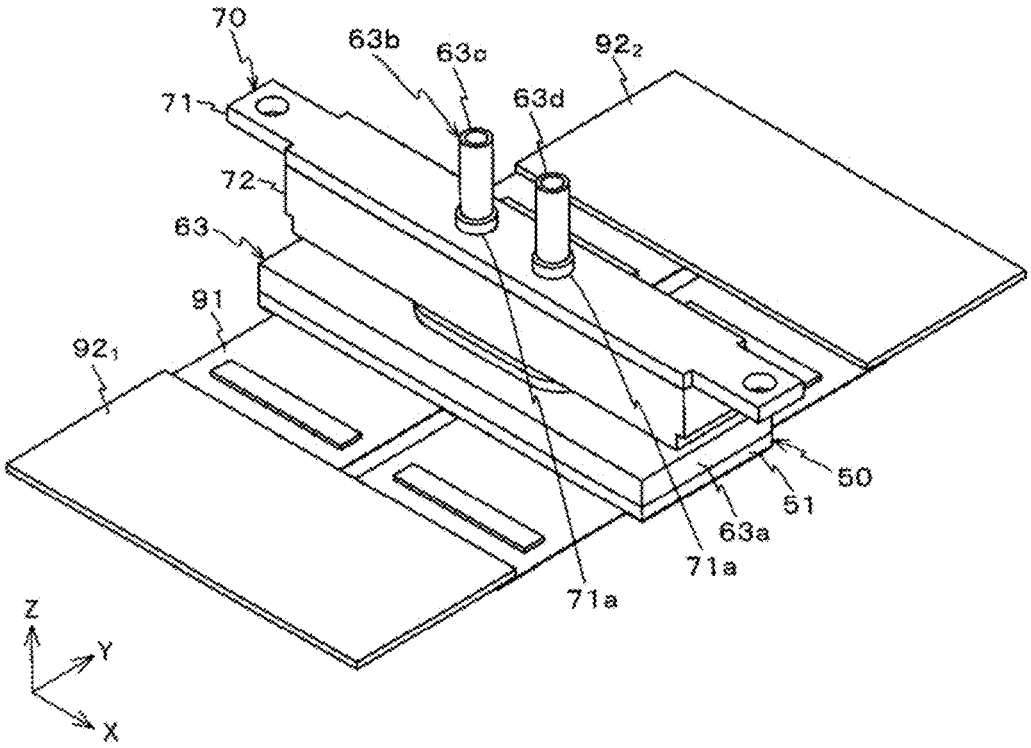
FIGS. 10-13 illustrate assembling steps of the inkjet head.

First, as shown in FIG. 10, the base 63*a*, which forms the manifold 63 of the circulation system 60, is adhered to the base substrate 51 of the head 50 to which the flexible printed circuit board 91 and the rigid printed circuit board 92 are connected. Then, the support member 73 of the support unit 70 is adhered to the connecting portions 63*c*, 63*d* in a state where the connecting portions 63*c*, 63*d* of the manifold 63 project from the openings 71*a* formed in the support plate 71 of the support unit 70.

Figure 11:
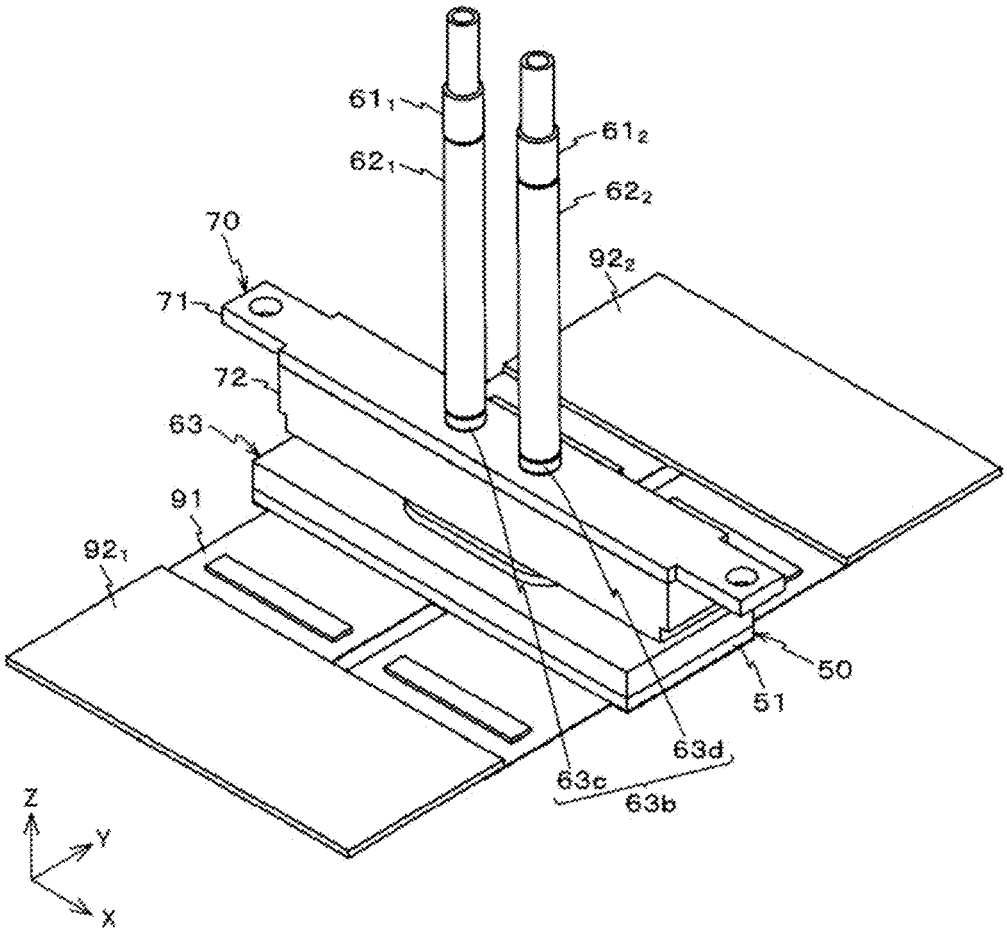

Next, as shown in FIG. 11, the pipes $\mathbf{62}_1$, $\mathbf{62}_2$ are connected to the connecting portions 63*c*, 63*d* of the manifold 63 respectively, and the connectors $\mathbf{61}_1$, $\mathbf{61}_2$ are connected to the pipes $\mathbf{62}_1$, $\mathbf{62}_2$, respectively.

Figure 12:
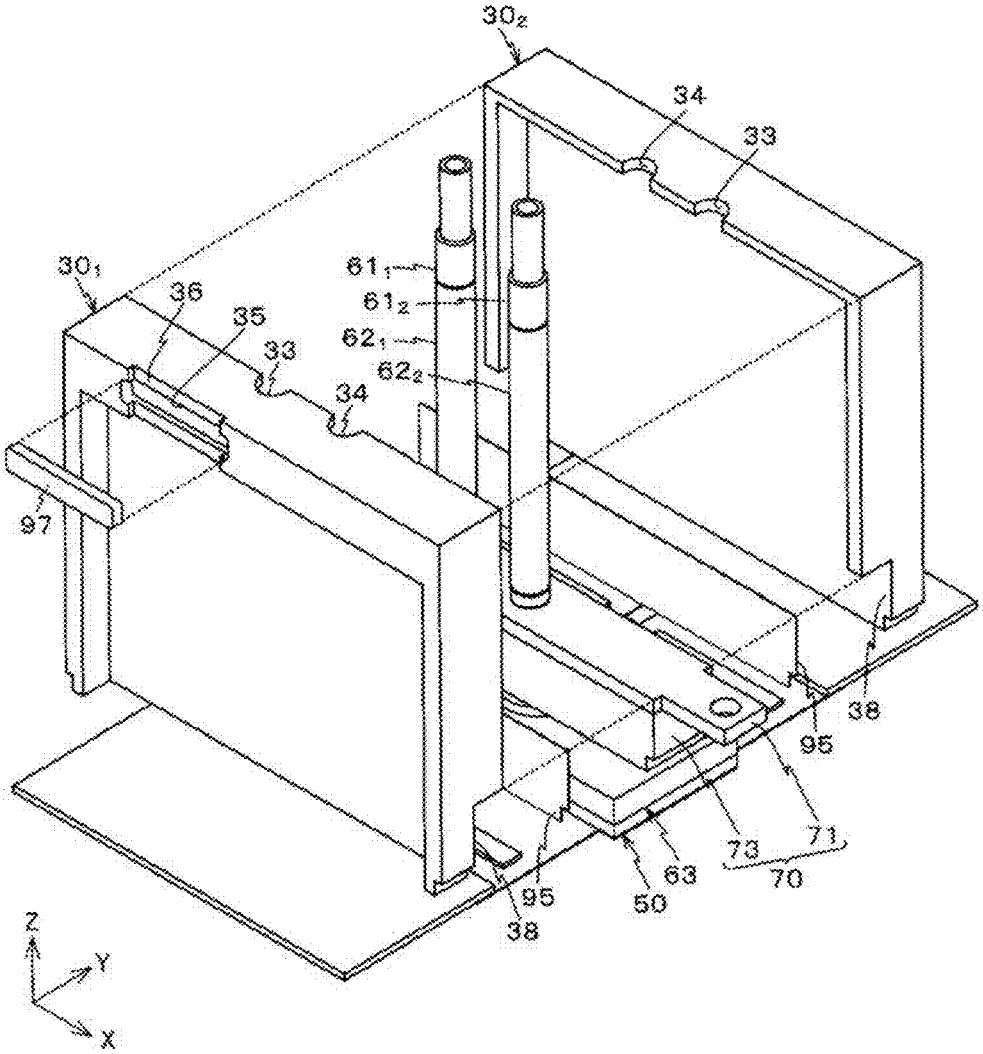

Next, as shown in FIG. 12, a rectangular-shaped seal member 97, of which longitudinal direction is the X axis direction, is inserted into the recessed portions 35 formed on the casing members $\mathbf{30}_1$, $\mathbf{30}_2$, respectively.

Figure 13:
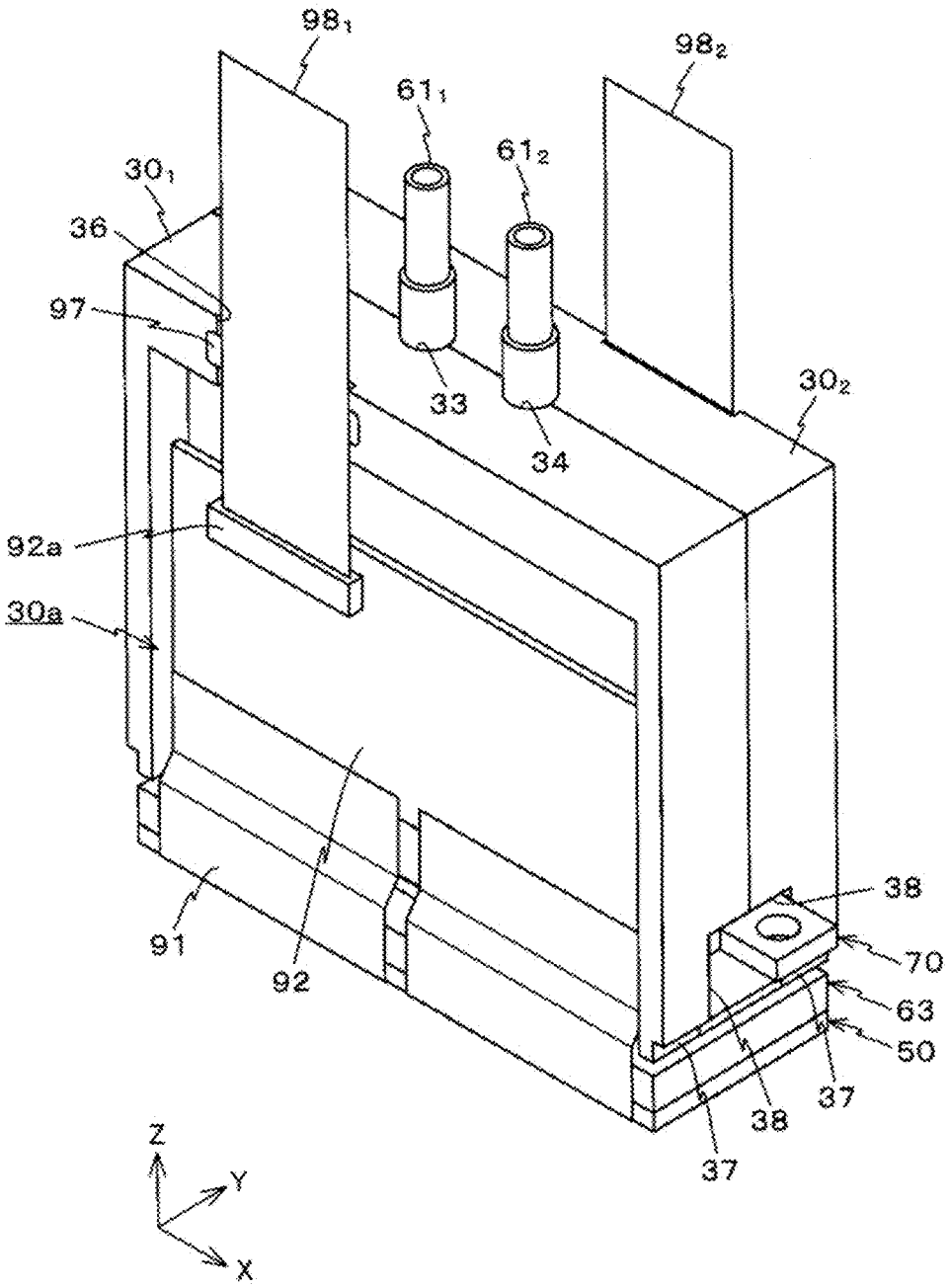

Next, as shown in FIG. 12, the casing members $\mathbf{30}_1$, $\mathbf{30}_2$ are fixed to the +Y side surface and the −Y side surface of the support member 73, which forms the support unit 70, using bolts. Seal members 95 made of rubber or silicon rubber are disposed between of the support member 73 and the casing members $\mathbf{30}_1$, $\mathbf{30}_2$, respectively. According to such a configuration, as shown in FIG. 13, the casing members $\mathbf{30}_1$, $\mathbf{30}_2$ are brought into close contact with each other. At this stage of assembling process, the connectors $\mathbf{61}_1$, $\mathbf{61}_2$ pass through circular openings formed of semicircular cutouts 33, 34, which are formed on the casing members $\mathbf{30}_1$, $\mathbf{30}_2$, respectively. Further, a +X side end portion and a −X side end portion of the support unit 70 extend from rectangular opening portions, each of which is formed of the cutouts 38 formed on the casing members $\mathbf{30}_1$, $\mathbf{30}_2$, respectively.

Next, as shown in FIG. 13, flexible cables $\mathbf{98}_1$, $\mathbf{98}_2$ are connected to connectors 92*a*, which are mounted on the ridged printed circuit boards $\mathbf{92}_1$, $\mathbf{92}_2$, respectively. The flexible printed circuit board 91 and the rigid printed circuit boards $\mathbf{92}_1$, $\mathbf{92}_2$ connected to the flexible printed circuit board 91 are housed in spaces 30*a* of the casing members $\mathbf{30}_1$, $\mathbf{30}_2$, respectively.

Next, as shown in FIG. 1, in a state where part of the flexible cables $\mathbf{98}_1$, $\mathbf{98}_2$ are positioned in the casing members $\mathbf{30}_1$, $\mathbf{30}_2$, respectively, the covers $\mathbf{40}_1$, $\mathbf{40}_2$ are attached to the casing members $\mathbf{30}_1$, $\mathbf{30}_2$, respectively, using bolts. The head 50 and the manifold 63 are covered with the mask plate 41 from below, and the projecting portion 41*a* of the mask plate 41 is adhered to a lower surface of the base substrate 51 of the head 50. The mask plate 41 is positioned such that the projecting portion 41*a* is in contact with the base substrate 51 of the head 50, and an upper end portion of the mask plate 41 is positioned at cutouts formed on the casing members $\mathbf{30}_1$, $\mathbf{30}_2$. The casing members $\mathbf{30}_1$, $\mathbf{30}_2$ and the covers $\mathbf{40}_1$, $\mathbf{40}_2$ may be collectively defined as a casing.

Figure 14:
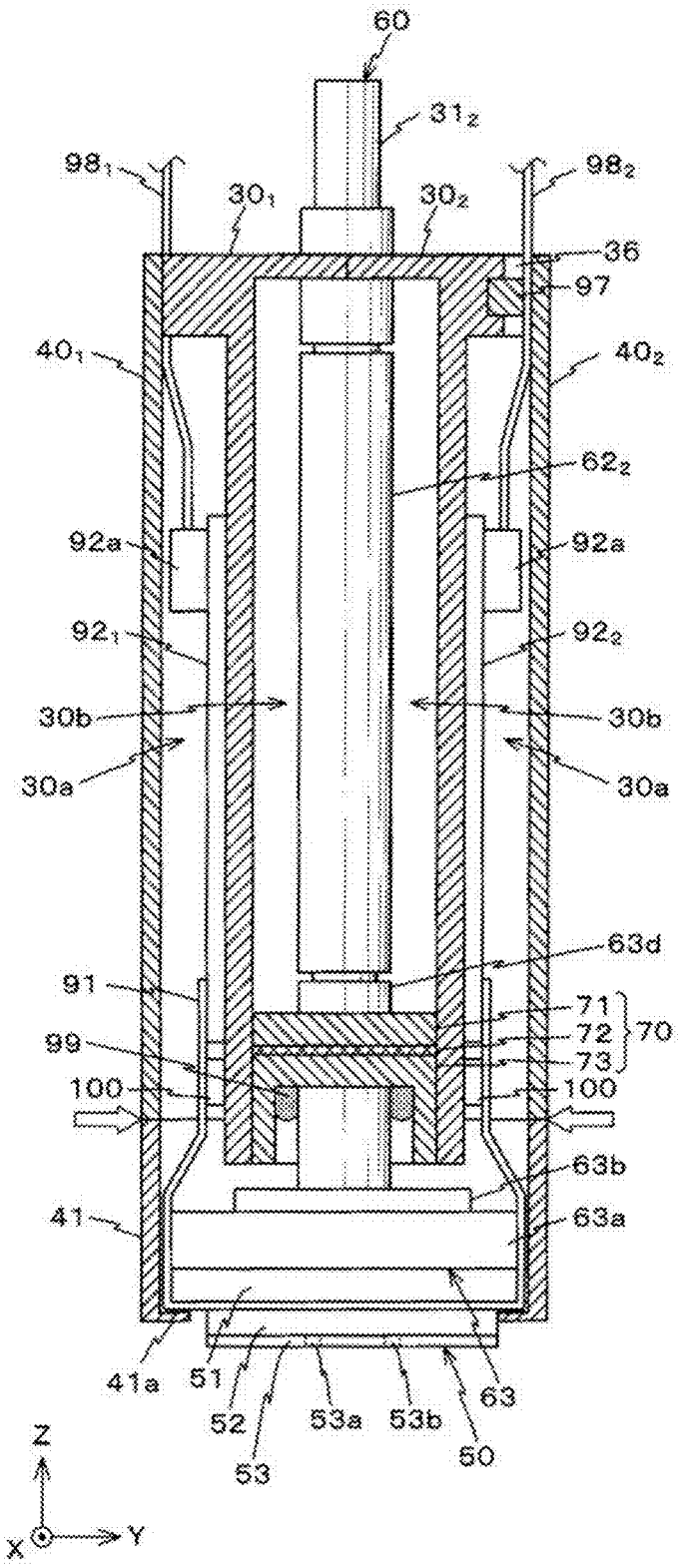
FIG. 14 is a cross sectional view of the inkjet head in a Y-Z plane.

FIG. 14 is a cross sectional view of the inkjet head 10 in a plane perpendicular to the x axis direction. In a state where the casing 30, the mask plate 41, the head 50, the circulation system 60, and the support unit 70 are assembled to each other as described above, the casing members $\mathbf{30}_1$, $\mathbf{30}_2$ are in close contact with each other, and the circulation system 60 is housed in the spaces 30*a* formed in the casings $\mathbf{30}_1$, $\mathbf{30}_2$. Further, the flexible printed circuit board 91 and the rigid printed circuit boards $\mathbf{92}_1$, $\mathbf{92}_2$ are housed in a space defined by the casing members $\mathbf{30}_1$, $\mathbf{30}_2$, the covers $\mathbf{40}_1$, $\mathbf{40}_2$, and the mask plate 41.

In the inkjet head 10, contact surfaces of the casing 30 and the cover 40 are a flat surface. Sealing treatment is applied to a gap formed between the cover 40 and the mask plate 41 and indicated by void arrows in FIG. 14 using an adhesive agent, silicon or the like, for example. According to such sealing treatment, the space in which the flexible printed circuit board 91 and the rigid printed circuit boards $\mathbf{92}_1$, $\mathbf{92}_2$ are housed is hermetically sealed, and as a result the inkjet head 10 shown in FIG. 1 is manufactured.

As described above, in the inkjet head 10 according to the present embodiment, by coupling the cover 40 and the mask plate 41, the space in which the flexible printed circuit board 91 and the rigid printed circuit boards $\mathbf{92}_1$, $\mathbf{92}_2$ are housed is hermetically sealed. Accordingly, ink ejected from the head 50 is unlikely to stick to the flexible printed circuit board 91 and the rigid printed circuit board 92. As a result, it is possible to prevent a malfunction of the inkjet head 10 that may be caused by short-circuiting of the electric circuit or the like.

In the inkjet head 10 according to the present embodiment, as shown in FIG. 14, the driver ICs $\mathbf{100}_1$, $\mathbf{100}_2$, which controls ink ejection from the openings 53*a* (nozzles), and the driver ICs $\mathbf{100}_3$, $\mathbf{100}_4$, which controls ink ejection from the openings 53*b* (nozzles) are housed separately. Accordingly, compared to a case where four driver ICs 100 are collectively housed, heat radiation efficiency from each one driver IC 100 can be improved. As a result, heat generated by each driver IC 100 may be efficiently radiated.

In the inkjet head 10 according to the present embodiment, as the contact surfaces of the casing 30 and the cover 40 are a flat surface, by simply assembling the casing 30 and the cover 40, it is possible to reduce a gap between the casing 30 and the cover 40, and as a result may prevent the intrusion of ink through the gap. Accordingly, by simply coupling the cover 40 and the mask plate 41, the driver ICs 100 and the rigid printed circuit board 92 may be hermetically sealed. As a result, it is possible to reduce the number of steps required for performing a sealing treatment and, as a result, it is possible to reduce a manufacturing cost of the device.

In the inkjet head 10 according to the present embodiment, when the support member 73 of the support unit 70 and the connecting portions 63*c*, 63*d* of the connector 63*b* which forms the manifold 63 are connected to each other, as shown in FIG. 14, an adhesive agent 99 is filled in the support member 73. As a result, a gap formed between the support member 73 and the connecting portions 63*c*, 63*d* can be sealed by the adhesive agent 99. Accordingly, the support unit 70 may support the circulation system 60, and the support unit 70 may also reliably separate the space in which the driver ICs 100 are housed and the space in which the circulation system 60 is housed from each other.

In the inkjet head 10 according to the present embodiment, as shown in FIG. 14, the driver ICs 100 are in contact with the casing 30. For this reason, heat generated by the driver ICs 100 may be efficiently transferred to the casing 30. As the casing 20 formed of the casing 30 and the cover 40 serves as a heat sink, heat generated by the driver ICs 100 may be efficiently radiated to the outside.

Although an embodiment is described above, the present disclosure is not limited to the above-described embodiment. For example, in the above-described embodiment, as shown in FIG. 14, a gap formed between the flexible cable 98 and the cutout 36 formed on the casing 30 is sealed by a sealing member 97. The present disclosure is not limited to such a configuration, and the gap formed between the flexible cable 98 and the cutout 36 formed on the casing 30 may be sealed by using an adhesive agent or silicon.

In the above-described embodiment, the gap formed between the casing 30 and the cover 40 is sealed by fixing the casing 30 and the cover 40 to each other. The present disclosure is not limited to such a configuration, and the gap formed between the casing 30 and the cover 40 may be sealed using an adhesive agent, silicon or the like, to improve the sealing property.

The inkjet head 10 according to the above-described embodiment is one example. The number of the openings 53*a*, 53*b* formed in the head 50 and a size of the head 50 may be appropriately modified in accordance with use and the resolution of the inkjet head 10.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink jet head comprising:

an ejection unit including first nozzles arranged along a line, second nozzles arranged parallel to the first nozzles, a first actuator configured to cause ink to be ejected from the first nozzles, and a second actuator configured to cause ink to be ejected from the second nozzles;

a first drive circuit configured to drive the first actuator;

a second drive circuit configured to drive the second actuator;

a pipe through which ink is circulated between the ejection unit and an ink tank; and a casing having therein a first space on a first side of the casing, a second space on a second side of the casing that is opposite to the first side, and a third space that is formed between the first space and the second space and sealed off from the first and second spaces, the first drive circuit being housed in the first space, the second drive circuit being housed in the second space, and the pipe at least partially being housed in the third space.

2. The ink jet head according to claim 1, wherein the first and second spaces are each defined between an outer cover of the casing and an inner wall of the casing, the inner wall of the casing being formed of metal, and the first drive circuit is in contact with the inner wall of the casing, and the second drive circuit is in contact with the inner wall of the casing.

3. The ink jet head according to claim 1, wherein the first drive circuit includes a driver IC configured to drive the first actuator, and the second drive circuit includes a driver IC configured to drive the second actuator.

4. The ink jet head according to claim 1, wherein the third space is defined between the inner wall of the casing with which the first dive circuit is in contact and the inner wall of the casing with which second dive circuit is in contact.

5. The ink jet head according to claim 4, further comprising:

a sealing member mounted around the pipe to isolate the third space from the first and second spaces.

6. The ink jet head according to claim 1, wherein the casing includes a cover enclosing the ejection unit.

7. The ink jet head according to claim 6, wherein an outer cover of the casing defining the first space and an outer cover of the casing defining the second space are opposite to each other, and an edge sectional surface of the cover is in contact with edge sectional surfaces of the outer covers.

8. The ink jet head according to claim 1, wherein the first and second drive circuits are each formed on a sheet of a flexible printed circuit.

9. The ink jet head according to claim 1, further comprising:

a first wiring electrically connected to the first drive circuit and extending from the first space to the outside of the casing; and a second wiring electrically connected to the second drive circuit and extending from the second space to the outside of the casing.

10. The ink jet head according to claim 9, further comprising:

a first seal member sealing a gap between the first wiring and the casing; and a second seal member sealing a gap between the second wiring and the casing.

11. An ink jet head comprising:

an ejection unit having a nozzle plate including first and second rows of nozzles arranged in parallel to each other and to first and second long edges of the nozzle plate, a first actuator configured to cause ink to be ejected from the first row of the nozzles, and a second actuator configured to cause ink to be ejected from the second row of the nozzles;

a first drive circuit formed on a first portion of a flexible board that extends from the first long edge of the nozzle plate and configured to drive the first actuator;

a second drive circuit formed on a second portion of the flexible board that extends from the second long edge of the nozzle plate and configured to drive the second actuator;

a pipe through which ink is circulated between the ejection unit and an ink tank; and a casing having therein a first space on a first side of the casing, a second space on a second side of the casing that is opposite to the first side, and a third space that is formed between the first space and the second space and sealed off from the first and second spaces, the first drive circuit being housed in the first space, the second drive circuit being housed in the second space, and the pipe at least partially being housed in the third space.

12. The ink jet head according to claim 11, wherein the casing includes a first inner wall and a second inner wall opposite to the first inner wall, and the first drive circuit is in contact with the first inner wall, and the second drive circuit is in contact with the second inner wall.

13. The ink jet head according to claim 11, wherein the first drive circuit includes a driver IC configured to drive the first actuator, and the second drive circuit includes a driver IC configured to drive the second actuator.

14. The ink jet head according to claim 11, wherein the casing includes a first inner wall and a second inner wall opposite to the first inner wall, and the third space is formed between the first inner wall and the second inner wall.

15. The ink jet head according to claim 14, further comprising:

a sealing member mounted around the pipe to isolate the third space from the first and second spaces.

16. The ink jet head according to claim 11, wherein the casing includes a first cover facing the first drive circuit, a second cover facing the second drive circuit, and a third cover enclosing the ejection unit.

17. The ink jet head according to claim 16, wherein the first cover and the second cover are opposite to each other, and an edge sectional surface of the third cover is in contact with edge sectional surfaces of the first and second covers.

18. The ink jet head according to claim 11, wherein the flexible board is a sheet of a flexible printed circuit.

19. The ink jet head according to claim 11, further comprising:

a first wiring electrically connected to the first drive circuit and extending to the outside of the casing; and a second wiring electrically connected to the second drive circuit and extending to the outside of the casing.

20. The ink jet head according to claim 19, further comprising:

a first seal member sealing a gap between the first wiring and the casing; and a second seal member sealing a gap between the second wiring and the casing.

* * * * *